United States Patent [19]

Shirao

[11] 3,973,427

[45] Aug. 10, 1976

[54] MOLD CHANGING APPARATUS FOR A PRESS MACHINE

[75] Inventor: Syoziro Shirao, Komatsu, Japan

[73] Assignee: Kabushiki Kaisha Komatsu Seisakusho, Tokyo, Japan

[22] Filed: June 11, 1975

[21] Appl. No.: 586,081

[52] U.S. Cl. ..... 72/448; 83/637; 100/DIG. 18

[51] Int. Cl.[2] ..... B21J 13/08

[58] Field of Search ..... 72/448, 446, 447, 405; 100/DIG. 18; 83/637; 29/568

[56] References Cited

UNITED STATES PATENTS

| | | | |
|---|---|---|---|
| 3,422,660 | 1/1969 | Countess | 72/448 |
| 3,427,854 | 2/1969 | Michelson | 72/448 |
| 3,452,633 | 7/1969 | Hammon | 83/637 |
| 3,602,079 | 6/1971 | Carlson | 83/637 |

FOREIGN PATENTS OR APPLICATIONS

| | | | |
|---|---|---|---|
| 777,110 | 6/1957 | United Kingdom | 100/DIG. 18 |

*Primary Examiner*—C.W. Lanham
*Assistant Examiner*—Gene P. Crosby
*Attorney, Agent, or Firm*—Armstrong, Nikaido & Wegner

[57] ABSTRACT

Mold changing apparatus is disclosed for a press having a slide for the upper mold, a movable bolster for the lower mold and transfer bars for successively transferring work pieces. In exchanging the molds, the upper mold is mounting on mounting members which are raised so as to move the upper mold above the transfer bars, thereby permitting the molds to be moved out of the press by the movement of the bolster without causing interference between the upper mold and the transfer bars held in position in the press.

2 Claims, 5 Drawing Figures

MOLD CHANGING APPARATUS FOR A PRESS MACHINE

BACKGROUND OF THE INVENTION

This invention relates to a press machine, particularly to a device for supporting an upper mold of the press machine during the exchanging of the molds.

In the prior art, when molds are to be exchanged in a forging press provided with transfer bars, the transfer bars must be detached from the forging press. Consequently, the efficiency of press is decreased by the troublesome and time consuming mold exchanging operation.

This invention is proposed in view of such circumstances as described above, and aims at providing a press machine which is capable of exchanging the upper mold without detaching transfer bars provided in a press machine.

SUMMARY OF THE INVENTION

It is an object of this invention to provide a press machine which is capable of exchanging the upper mold without detaching transfer bars provided in a press machine.

The above object is achieved in accordance with this invention by the provision of a press machine having a slide to which an upper mold is attached, a movable bolster to which a lower mold is attached and a pair of transfer bars for transferring work pieces successively, the press machine being characterized in that it comprises a pair of upper mold supporting mechanisms, each fixedly secured to the moving bolster in an upright position and provided with a mounting member at the upper end thereof capable of moving upward and downward for supporting the upper mold and removing the upper mold over the transfer bars out of the press by the movement of the bolster.

DETAILED DESCRIPTION OF THE PREFERRED EMBODIMENT

Normally, when exchanging the molds in a forging press provided with transfer bars, the transfer bars must be detached from the forging press, because the transfer bars interefere with the upper mold when it is removed, thereby deteriorating the efficiency.

The present invention provides a press machine which is capable of exchanging the upper mold without requiring the detaching of transfer bars provided in the press machine so that the efficiency is improved.

An embodiment according to this invention will be described with reference to the comparing with drawings.

Figure 1:
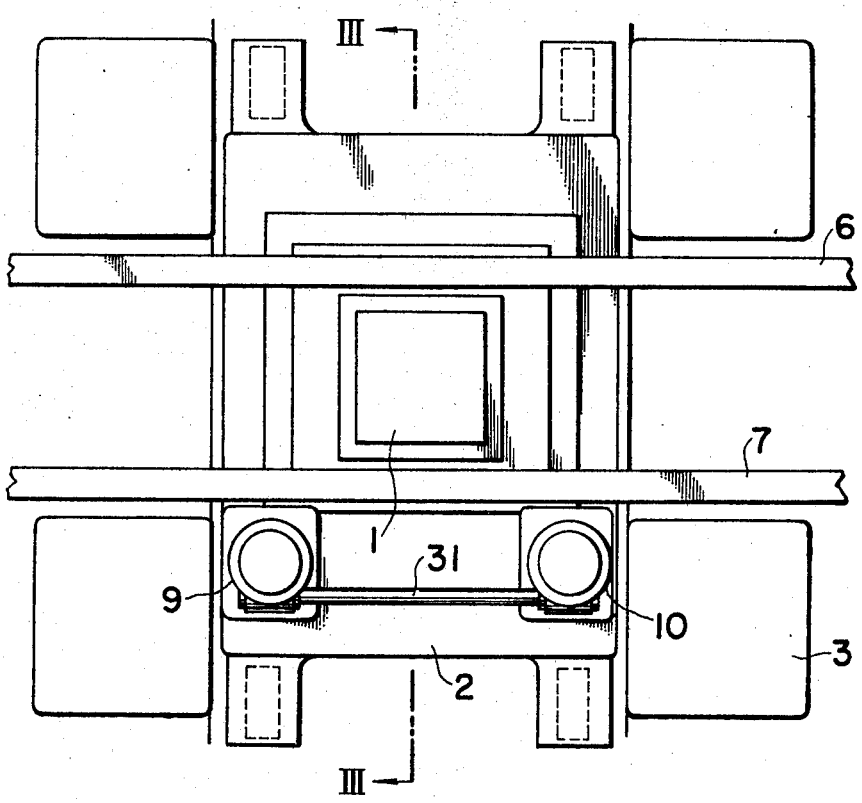
FIG. 1 is a plan view showing the press machine incorporating the device of the present invention.
Figure 2:
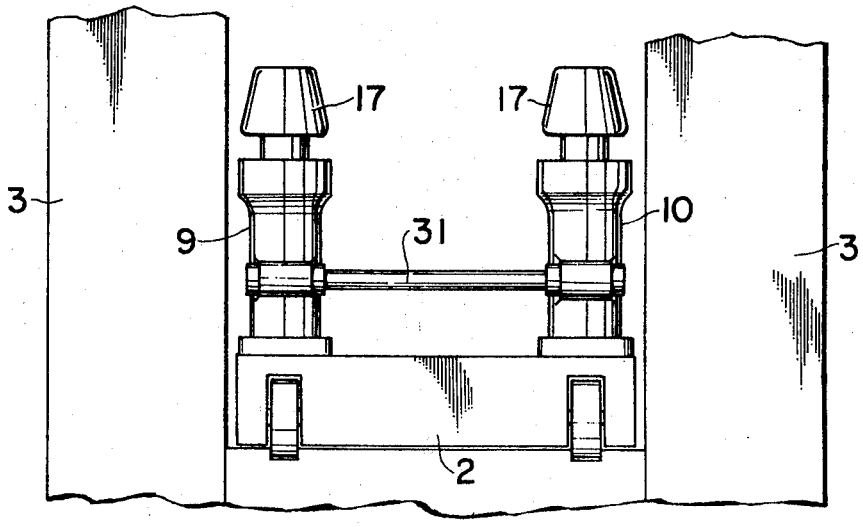
FIG. 2 is a front view of FIG. 1.
Figure 3:
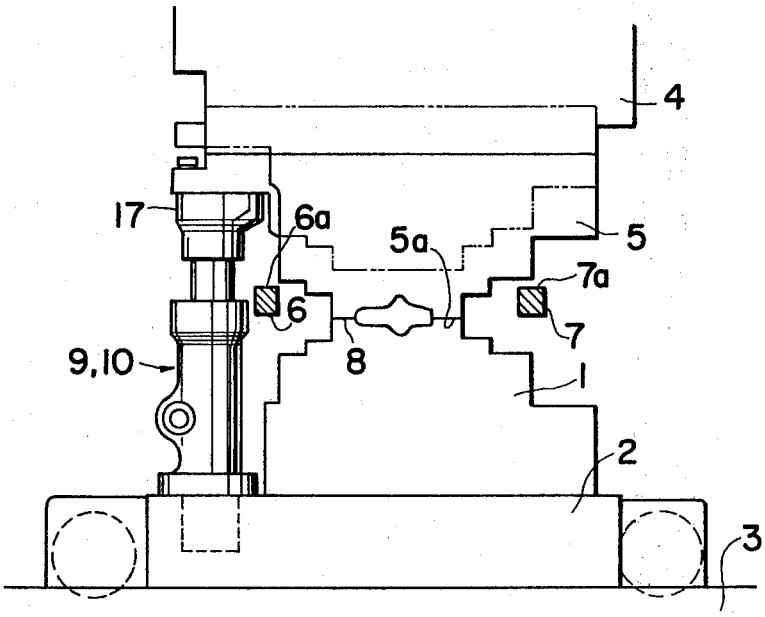
FIG. 3 is a sectional view along line III — III in FIG. 1.

The movable bolster 2 fixedly mounting thereon the lower mold 1 is capable of running to the front and rear directions of the main body 3 of the press machine and is placed and fixed at a given position in the press machine. The upper mold 5 is set on the slide 4 in opposing relation to the lower mold 1 as shown in FIG. 3. A pair of transfer bars 6 and 7 are arranged in parallel to each other at either sides of the molds 1, 5 slightly above the mating face 8 thereof, and extend in the direction perpendicular to the movement of the travelling bolster 2.

Figure 5:
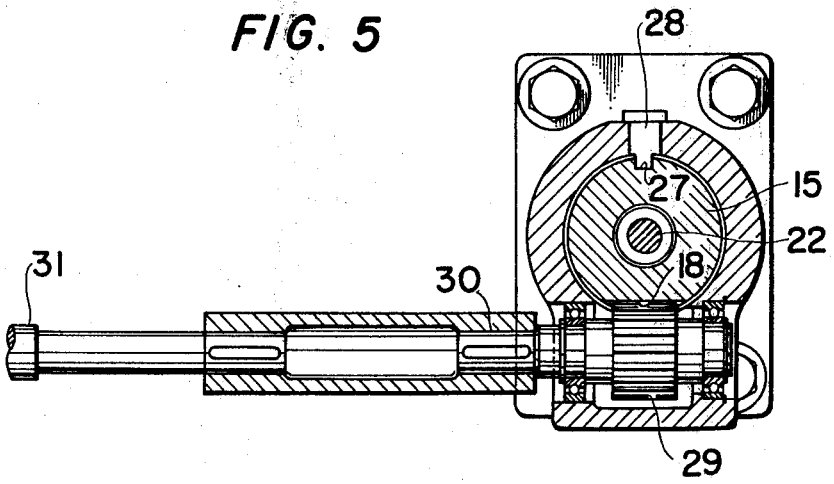
FIG. 5 is a sectional view taken along line V — V in FIG. 4.
Figure 4:
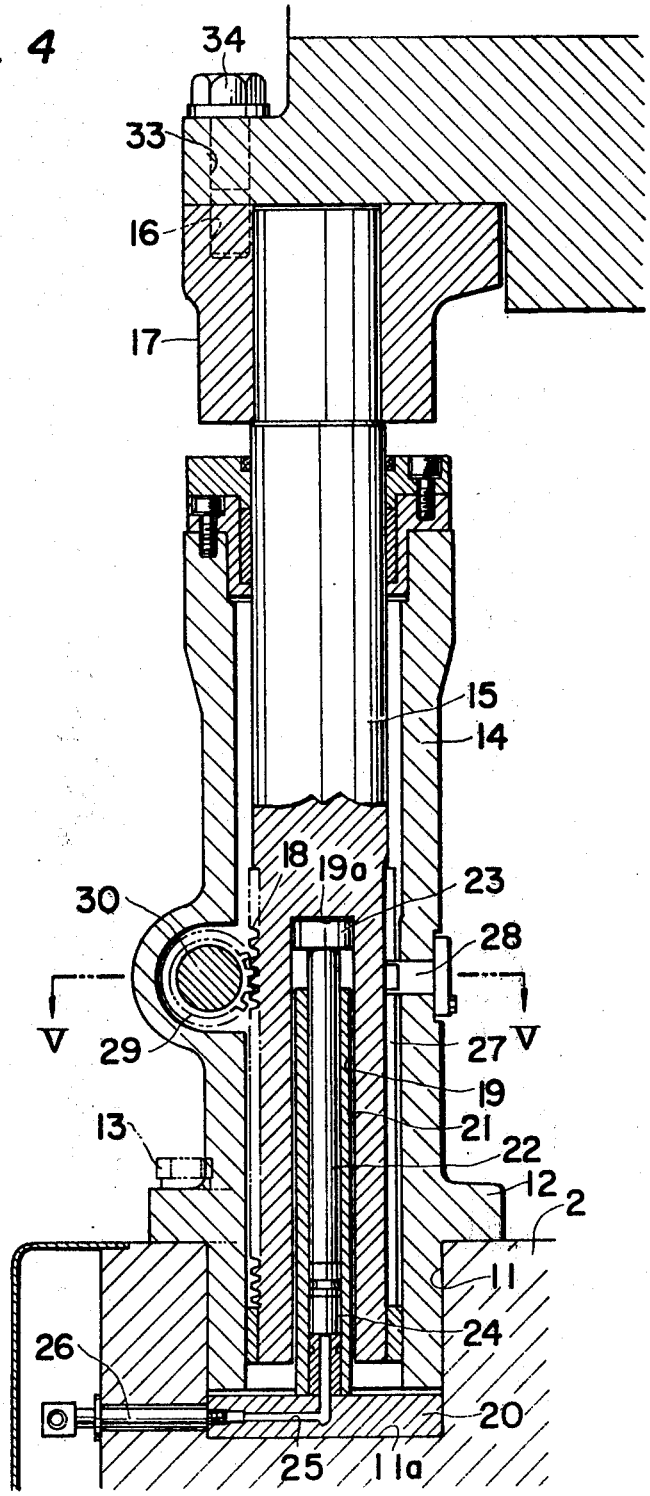
FIG. 4 is a fragmentary sectional view showing the upper mold supporting mechanism of the present invention.

A pair of upper mold support mechanisms 9 and 10 are secured in upright positions on one side of the travelling bolster 2 at the respective end thereof. Each of the lower portions of the upper mold supporting mechanisms 9 and 10 is fitted in the fitting hole 11 formed in the bolster 2 and fixedly secured thereto with the flange 12 tightened by bolts 13 to the bolster 2. A rod 15 is inserted in the cylindrical body 14 of the supporting mechanism 9, 10 as shown in FIG. 4 and 5 so as to be movable up and down in the body 14. A mounting member or a support member 17 for the upper mold 5 having threaded holes 16 is fixed on the upper end of said rod 15, and a rack 18 is formed at the peripheral face of the lower part of the rod 15 while a blind hole 19 is formed at the lower part of the rod 15 coaxially with the axis of the rod 15.

Within the blind hole 19, a cylinder 21 is loosely fitted and the lower end of the cylinder 21 is secured to a cover 20 engaged in the bottom end 11*a* of the fitting hole 11. A piston 22 is slidably fitted in the cylinder 21. An abutment member 23 is secured to the upper end of the piston 22 which is adapted to be contacted with the upper end wall 19*a* of the blind wall 19 when the piston 22 is moved upwardly. A pressure chamber 24 is formed in the cylinder 21 below the piston 22 and it is connected to a high pressure pump through oil hole 25 drilled in the cover 20 and oil hole 26 drilled in the travelling bolster 2. At the peripheral face of the lower portion of the rod 15, an axially extending groove 27 is formed, in which a stopper 28 secured to the cylindrical body 14 is slidably engaged so as to prevent the rotation of the rod 15. The rack 18 of the rod 15 in each of the supporting mechanisms 9, 10 is engaged with a pinion 29 rotatably mounted in the cylindrical body 14. The shaft 30 of the pinion 29 in each of the support mechanisms 9, 10 is connected together by intermediate connecting shaft 31 so that the movement of the rods 15 in each of the supporting mechanisms 9, 10 is moved upward and downward in synchronized relation to each other.

With the construction of the device as described above, when the mold is to be exchanged, the upper mold 5 is contacted with the lower mold 1 by the downward movement of the slide 4 to the lower dead point, and the bolts (not shown) securing the upper mold to the slide are removed. Then, the upper mold 5 is connected to the support member 17 each of the supporting mechanism 9, 10 by threading bolts 34 from the upper mold 5 into the holes 16 in the support members 17 through holes 33 of the upper mold 5, and the piston 22 is extended upwardly by supplying oil pressure to the pressure chamber 24 of the cylinder 21 through oil holes 25, 26 from the pressure source, while the slide 4 is raised to the upper dead point. When the piston 22 is extended upwardly by the oil pressure in the pressure chamber 24, the upper mold 5 is moved upward because the support members 17 are moved upward together with the rods 15 by the abutment of the pushing member 23 against the bottom 19*a* of the blind hole 19 in the rod 15. At this time the upper mold 5 is moved until the lower face 5*a* of upper mold 5 is positioned slightly above the upper face 6*a*, 7*a* of the transfer bars 6, 7, thereby permitting the upper mold 5 to be moved out without interfering with the transfer bars 6, 7. When the travelling bolster 2 in this condition is moved out of the press machine, the upper mold 5 and the lower mold 1 are drawn out of the press machine under the condition that they are supported on the travelling bolster 2. Since this invention is constituted as described above, when the mold is to be exchanged, the lower face 5*a* of upper mold 5 is capable of being positioned above the upper face 6*a*, 7*a* of the transfer bars 6, 7 by virtue of the operation of the supporting mechanisms 9, 10. As the result, the travelling bolster 2 can be moved out of the press machine without causing interference of the upper mold 5 with the transfer bars 6, 7 held in position in the press machine.

Accordingly, the operation of the mold exchange is made easy and the efficiency is improved because both the upper mold 5 and the lower mold 1 can be carried outside the press machine without requiring the removal of the transfer bars 6, 7.

I claim:

1. Press machine having a slide to which an upper mold is secured, a movable bolster to which a lower mold is attached for cooperation with the upper mold, and transfer bars for transferring work pieces successively, wherein the improvement comprises a pair of upper mold supporting mechanisms secured to the bolster, said mechaisms having upper mold mounting members movable up and downward so as to mount the upper mold thereon and raise the same above the transfer bars.

2. Press machine according to claim 1, wherein the upper mold mounting members of the supporting mechanisms are operatively connected to each other through a connecting rod so as to be moved in synchronism with each other.

* * * * *